US006799920B2

(12) United States Patent
Sondrup

(10) Patent No.: US 6,799,920 B2
(45) Date of Patent: Oct. 5, 2004

(54) ANGLE ADJUSTABLE UTILITY ACCESS AND METHOD

(75) Inventor: Chris Sondrup, Lindon, UT (US)

(73) Assignee: Precision Cover Systems, Inc., Lindon, UT (US)

( * ) Notice: Subject to any disclaimer, the term of this patent is extended or adjusted under 35 U.S.C. 154(b) by 0 days.

(21) Appl. No.: 10/262,560

(22) Filed: Sep. 30, 2002

(65) Prior Publication Data

US 2004/0013466 A1 Jan. 22, 2004

Related U.S. Application Data

(63) Continuation-in-part of application No. 09/814,627, filed on Mar. 22, 2001, now Pat. No. 6,524,026, and a continuation-in-part of application No. 09/815,411, filed on Mar. 22, 2001, now Pat. No. 6,520,713, and a continuation-in-part of application No. 09/653,714, filed on Sep. 1, 2000, now Pat. No. 6,457,901.

(51) Int. Cl.[7] ..... E02D 29/14

(52) U.S. Cl. ..... 404/26; 404/72

(58) Field of Search ..... 404/25, 26, 72; 52/19, 20

(56) References Cited

U.S. PATENT DOCUMENTS

| | | | | | |
|---|---|---|---|---|---|
| 1,639,495 | A | * | 8/1927 | Frame | 404/26 |
| 4,158,515 | A | * | 6/1979 | Helms | 404/72 |
| 4,197,031 | A | * | 4/1980 | Hild | 404/26 |
| 5,165,819 | A | * | 11/1992 | Bowman | 404/26 |
| 5,470,172 | A | * | 11/1995 | Wiedrich | 404/25 |
| 5,513,926 | A | * | 5/1996 | Prescott | 404/26 |
| 5,584,317 | A | * | 12/1996 | McIntosh | 137/363 |
| 5,956,905 | A | * | 9/1999 | Wiedrich | 52/20 |

FOREIGN PATENT DOCUMENTS

| | | | |
|---|---|---|---|
| JP | 7-317088 | * | 12/1995 |
| JP | 8-158390 | * | 6/1996 |
| JP | 10-102523 | * | 4/1998 |
| JP | 2000-87374 | * | 3/2000 |

* cited by examiner

*Primary Examiner*—Gary S. Hartmann
(74) *Attorney, Agent, or Firm*—Thorpe North & Western

(57) ABSTRACT

An adjustable utility access device and method includes a pair of angled rings disposed between a utility and a cover. The angled rings can include a frame and a rotatable ring. A angular scale can be disposed on one of the rings to indicate the angle formed by the rings. An orientation scale can be disposed on one of the rings to align the orientation of the angle. Two rotational settings can be determined based on measurements of the utility to allow the rings to be properly rotated and aligned.

24 Claims, 9 Drawing Sheets

ANGLE ADJUSTABLE UTILITY ACCESS AND METHOD

This is a continuation in part and Priority is claimed of application Ser. No. 09/653,714, now U.S. Pat. No. 6,457,901, issued Oct. 1, 2002, and filed Sep. 1, 2000; and U.S. patent application Ser. No. 09/814,627 now U.S. Pat. No. 6,524,026 and Ser. No. 09/815,411, now U.S. Pat. No. 6,520,713, both filed Mar. 22, 2001.

BACKGROUND OF THE INVENTION

1. Field of the Invention

The present invention relates generally to a utility access, such as a manhole. More particularly the present invention relates to an angle adjustable utility access or manhole and method for aligning a cover to sit flush with a surrounding surface, such as a road.

2. Related Art

A utility access provides access to various underground equipment associated with various utilities. Examples of utilities include sewer pipelines or systems, electrical cables or systems, telephone cables or systems, natural gas lines or systems, gas or oil pipelines or systems, cable television lines or systems, water or drainage pipelines or systems, etc. Examples of equipment associated with the utilities include pipelines, cables, valves, meters, switches, storage, etc. The utility access can be large enough for a worker to physically pass therethough, such as a manhole, or can be smaller providing only visual access, such as for a meter, or providing only tool access, such as for a valve.

As an example, a manhole is an opening in any surface large enough to allow workmen to descend beneath the surface to obtain access to stored materials or equipment or underground installations. The openings are normally in areas carrying traffic so that a means of securely framing and covering the opening must be provided. The manholes must also be strong enough to withstand various external loadings, for example the loading of vehicles moving over the manhole.

In the prior art, the standard procedure has been to frame the opening with a gray iron casting. These castings typically rest on a supporting structure that is located under ground. This supporting structure typically comprises standard concrete rings long enough so that a number of them form a passage to reach the underground installation. The flanged surface of the manhole transmits the weight of the equipment, together with live surface loads, to the supporting structure. The frame typically incorporates a projecting ledge around the circumference and a cast iron cover rests on the ledge and closes the manhole. The cover is a removable casting designed to carry the surface loads, and must transmit those forces to the underground supporting structure through the frame. The cover must be heavy to avoid vandalism. In some cases it is bolted down in order to make the installation watertight and tamper proof.

In one situation, a subsequent layer of surfacing material (for example, asphalt) is added to the road surface. When this happens, the manhole may need to be adjusted to match the height of the new road. Typically, adjustment is done by filling the space between the manhole top structure and the supporting manhole frame structure with layers of bricks and mortar. This is a manual, time-consuming procedure. In addition, spacers may be used.

In addition, road surfaces are often sloped to resist the accumulation of water on the road surface. It will be appreciated that it is often difficult to match the orientation of the manhole cover with the slope of the road.

A pair of angled rings has been developed in order to adjust the angle or pitch of the cover. Rotating the rings with respect to one another adjust the angle or pitch. The rings can be inserted below the cover. It will be appreciated that obtaining the desired angle can be difficult. The angle obtained by the rings can be difficult to ascertain. In addition, the orientation of the created angle also changes as the angle is adjusted by the rotating rings. Thus, it will also be appreciated that properly orienting the created angle also can be difficult. The orientation of the created angle also can be difficult to ascertain. An inordinate amount of time can be expended by installation crews in attempting to obtain the proper angle and orientation by trial-and-error. Similarly, it can be undesirably to require the presence and assistance of a project engineer for every utility installation. Such wasted time and/or engineering assistance can increase the cost of installation, and counteract the advantages intended by the angled rings.

SUMMARY OF THE INVENTION

It has been recognized that it would be advantageous to develop a method and apparatus for installing an adjustable utility access. In addition, it has been recognized that it would be advantageous to develop such method and apparatus suited for a standard installation crew.

The invention provides a method and an apparatus for adjusting an adjustable utility access device on a utility with respect to a surface, such as a roadway. The adjustable utility device can include a pair of angled rings that are stackable and rotatable with respect to one another. Each ring can be angled and the rings together can have an upper end and a lower end so that rotating the rings with respect to one another to form an inclination angle between the upper and lower ends. Thus, the rings can enable selection of an inclination angle to orient a cover of the utility access device with the surface.

In accordance with a more detailed aspect of the present invention, a vertical angle scale and an indicator each can be carried by a different one of the rings. The vertical angle scale and the indicator facilitate indication of the inclination angle formed between the upper and lower ends of the rings caused by the relative rotational orientation of the rings with respect to one another.

In accordance with another more detailed aspect of the present invention, horizontal orientation indicia can be disposed on one of the rings. The indicia can facilitate horizontal orientation of the inclination angle of the rings with a reference.

In accordance with another more detailed aspect of the present invention, the device can include or be provided with means for determining two rotational settings, including a first angle setting corresponding to a desired inclination angle formed between the upper and lower ends of the rings, and a second orientation setting corresponding to a desired horizontal orientation of the desired inclination angle. The rotational settings can be determined using a spreadsheet, a computer program, a calculator, a slide rule, a chart, etc.

In accordance with another more detailed aspect of the present invention, the pair of rings can include a frame and a rotatable ring. The frame can be disposed directly on the utility and rotatable with respect to the utility, while the rotatable ring can be rotatably disposed on the frame. The vertical angle scale can be formed on the frame, while the indicator can be formed on the rotatable ring. The horizontal orientation indicia also can be disposed on the frame.

In accordance with another more detailed aspect of the present invention, an extension ring can be selectively disposed on the rotatable ring. The extension ring can include at least one tab attached thereto selectively engagable with at least one of a plurality of steps formed on the rotatable ring to selectively adjust the height of the extension ring.

In accordance with another more detailed aspect of the present invention, at least one projection can be attached to the horizontally oriented flange and can extend outwardly from the frame past a perimeter of the horizontally oriented flange to facilitate selective orientation of the frame during installation.

A method for adjusting an adjustable utility access with respect to a road surface includes providing upper and lower angled rings on a utility. A reference point is selected on the utility. A plurality of distances is measured between a top of the utility to a reference elevation at a plurality of different points around the utility. Two rotational settings are determined based on the distances measured. The rotational settings can including a first angle setting corresponding to a desired inclination angle formed between the upper and lower ends of the rings, and a second orientation setting corresponding to a horizontal orientation of the inclination angle of the rings. One of the rings is rotated with respect to the other ring to the first angle setting to obtain the desired inclination angle formed between the upper and lower ends of the rings; The lower ring is rotated with respect to the utility to the second orientation setting to obtain a desired horizontal orientation of the inclination angle of the rings.

In accordance with a more detailed aspect of the present invention, the step of measuring can further include measuring four distances at four, equally spaced, circumferential positions around an opening in the utility. In addition, the step of determining can further include determining two rotational settings based on the four distances measured and a diameter of the opening.

In accordance with another more detailed aspect of the present invention, the step of determining can include utilizing determining means. The determining means can include a spreadsheet, a computer program, a calculator, a slide rule, a chart, etc.

In accordance with another more detailed aspect of the present invention, the step of rotating the rings can further include engaging the ground with a distal end of a lever arm. A protrusion which extends from one of the rings is engaged with an intermediate section of the lever arm which is adjacent the distal end. The lever arm is pivoted about the distal end thereof by applying a force to a proximal end of the lever arm.

A method for adjusting an adjustable utility access with respect to a road surface includes selecting a reference point on the utility. A first angled ring is selectively oriented on the utility with respect to the reference point. A second angled ring rotatably disposed on the first ring is selectively rotated to obtain a desired inclination angle of an upper end of the second angled ring. A horizontal orientation of the desired inclination angle with respect to the reference point is determined. The first angled ring is rotated on the utility to align the horizontal orientation to orient the desired inclination angle with respect to the reference point.

Additional features and advantages of the invention will be apparent from the detailed description which follows, taken in conjunction with the accompanying drawings, which together illustrate, by way of example, features of the invention.

DETAILED DESCRIPTION

Figure 1:
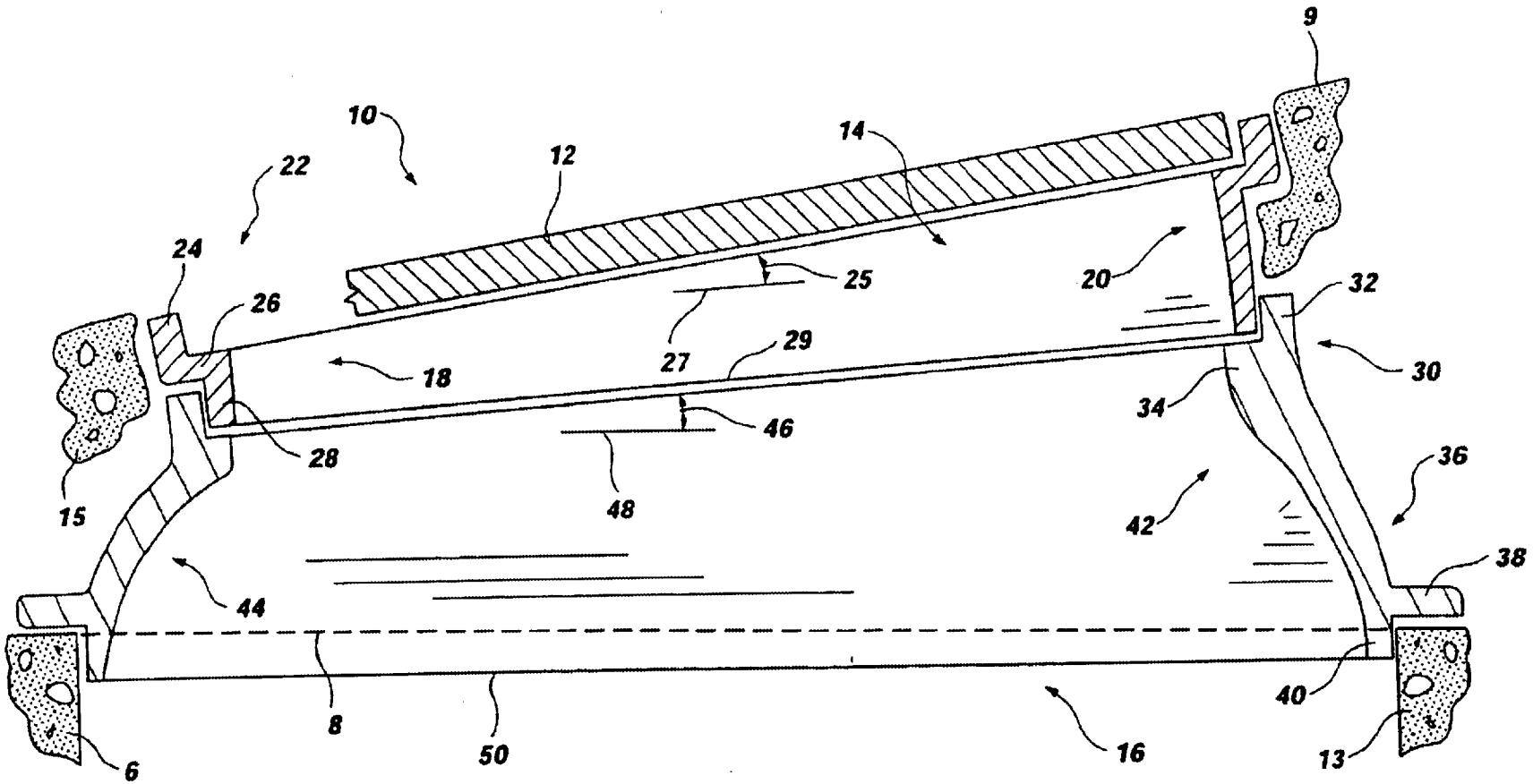
FIG. 1 is a cross-sectional side view of an angularly adjustable utility access device in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides an adjustable utility access and method to facilitate adjustment of the adjustable utility access with respect to a surface. The utility access and method can include one or more scales or indicia formed on the rings to facilitate aligning the angles with respect to each other to obtain a desired inclination angle, and with respect to a utility of obtain a desired horizontal orientation of the inclination angle. In addition, the utility access and method can include a means for determining one or more rotational settings based on simple measurements that allow the rings to be adjusted by simply performing the measurements, and rotating the rings to the rotational settings in order to obtain the desired inclination angle and horizontal orientation.

The adjustable utility access and method can adjust or vary the height and/or angle of a cover to allow a top of the cover to be oriented and located as desired, such as to sit flush with the surrounding surface or road. Manholes or manhole access are examples of a field that can benefit from the use of such an adjustable utility access. While the invention is illustrated and described below as being configured for use as a manhole for providing access to a utility beneath a roadway, it is of course understood that the present invention can be configured for access to any structure, storage, or utility, including for example, water lines, water valves, water meters, gas lines, gas valves, cable lines and equipment, electrical lines and equipment, etc.

The present invention provides a utility access device that can be used with a utility structure for various underground equipment. The utility access device can be configured for use with the particular utility structure. As stated above, the utility structure can be for pipelines, cables, valves, switches, storage, etc. associated with sewer, drainage, telephone, cable television, electrical, gas or oil systems, and the like. The utility access device can be sized larger to accommodate the passage or a worker therethrough, or smaller to accommodate only tools or visual inspections. The terms "utility" and "utility structure" are used interchangeably herein to broadly describe a structure upon which the utility access device is placed, such as concrete rings, a cone, a manhole extension, etc.

By way of example, the utility access device is described below and illustrated herein with respect to a manhole. The utility access can be disposed on, or attached to, a utility 6, or upper surface or top edge 8 thereof. The utility 6 can be a manhole extension and has a hole forming a vertical shaft for workmen to climb down for access to underground utilities, storage or structures. Typically, the utility access is surrounded by supporting ground material 9, such as concrete or asphalt. The upper surface or top edge 8 is typically perpendicular to a plumb line to ensure a vertical shaft for sewer workers to climb down into. Typically, the utility access and utility 6 are located underneath a surface, such as a roadway, and the cover typically must be flush with the surface or roadway.

Various aspects of adjustable utility access devices are described in U.S. Pat. No. 6,457,901, issued Oct. 1, 2002, and filed Sep. 1, 2002; and U.S. patent application Ser. Nos. 09/814,627 and 09/815,411, both filed Mar. 22, 2001; which are herein incorporated by reference.

As illustrated in FIG. 1, an angle adjustable utility access device or manhole assembly 10 is shown for adjusting or varying the angular orientation of a utility or manhole cover 12. As stated above, the utility access 10 can be disposed on the utility 6, or upper surface 8 thereof, and can be surrounded by supporting ground material 9, like concrete or asphalt. The utility access 10 can include a pair of angled rings that stack and rotate with respect to one another. The rings can include a rotatable ring or upper ring 14, and a frame or lower ring 16. The rings are stacked on top of the utility 6, and support the utility cover 12. The upper ring 14 may have a coupling 22 for holding the lid 12 onto the ring 14. The coupling 22 would typically, but not necessarily, include a lid wall 24 for holding the manhole lid 12, and a shoulder or flange 26 for supporting the lid 12.

The upper ring 14 has a height dimension that increases uniformly from a first height associated with a first side 18, and maximizes at a second height associated with a second side 20. The upper ring 14 has a variable height wall 28 that uniformly increases in height from the short side 18 to the maximum height side 20. The upper ring 14 also has a bottom edge 29 that is parallel to line 27 that illustrates an angle 25 that is created from the height variation between sides 18 and 20. The upper ring 14 also has a top edge that is angled or inclined with respect to the bottom edge 29. In one aspect, the created angle 25 can be between two and ten degrees.

The frame or lower ring 16 includes a top edge with a coupling 30 for coupling to the bottom edge 29 of the upper ring 14. The coupling 30 may be designed with a vertical holding wall 32, for holding the upper ring 14 from moving off of the frame or lower ring 16, and a shoulder or flange 34 for supporting the upper ring 14. The frame or lower ring 16 also can include a bottom edge with a coupling 36 for holding the frame or lower ring 16 on the utility or manhole extension 6. The coupling 36 can include a horizontal, outwardly extending flange 38 for holding the whole utility access or adjustable ring assembly 10 on top of the utility 6, and an annular protrusion 40 extending vertically downwardly into the opening of the utility for holding the frame or lower ring 16 from sliding off of the utility 6.

The frame or lower ring 16 also has a shorter side 44 and a taller side 42 that form an angle 46. It is noted that line 48 is parallel to a bottom edge 50 and is positioned to illustrate the angle 46. The frame or lower ring 16 can have a top edge that is angled with respect to the bottom edge 50. The angle 46 can be between two and ten degrees. The bottom edge 50 of the base ring 16 can be parallel to the top edge 8 of the utility 6.

The upper ring 14 is rotatably disposed on the frame or lower ring 16. Thus, the upper ring 14 can be selectively rotated on the frame or lower ring 16 to selectively orient the top edge of the upper ring 14, or the cover 12. Thus, one ring can be rotated with respect to another to obtain the desired angle or pitch, and both rings can be rotated together to properly orient the angle or pitch. A maximum amount of pitch to the cover 12 is achieved by placing the shortest sections 18 and 44 of the upper and lower rings 14 and 16 upon each other, as currently illustrated, which will position the largest ends 20 and 42 upon each other. Additionally, it is possible to have the cover 12 in a zero pitch, or a zero degree slope. This is accomplished by having the largest and smallest sections 18 and 42, and 20 and 44, stacked above each other. Specifically, the angle achieved by the one ring would be off set by the opposite angle provided by the other ring.

Figure 2:
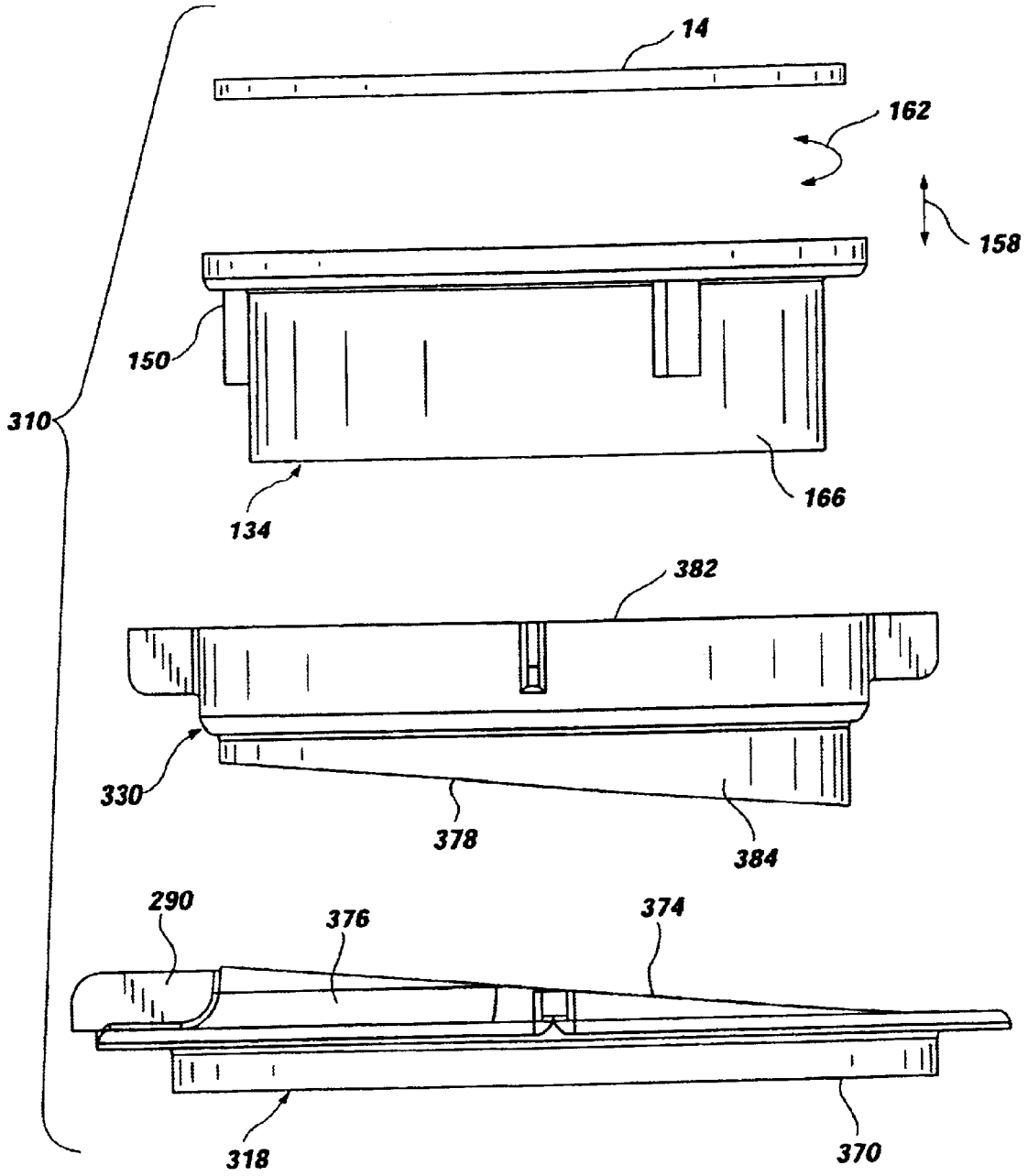
FIG. 2 is an exploded side view of a height and angle adjustable utility access device in accordance with the present invention.

As illustrated in FIG. 2, a height and angle adjustable utility access device, indicated generally at 310, in accordance with the present invention is shown for adjusting the height and angle of a cover 14 to be flush with a surface (not shown), such as a roadway. The utility access device 310 can include the cover 14 and a frame or lower ring 318. The frame 318 is similar in many respects to the frame described above. The utility access device 310 advantageously includes a height adjustment mechanism or means for adjusting the height of the cover 14 with respect to the frame 318, and thus with respect to a surface or roadway. In addition, the utility access device 310 advantageously includes an angle adjustment means for adjusting the angle of the cover 14 relative to the frame 318, and thus with respect to a surface or roadway.

The utility access device 310 includes a pair of angled rings, or the frame or lower ring 318, and the rotatable or upper ring 330. In one aspect, the utility access device 310 further includes a third ring or extension ring 134. The rotatable or upper ring 330 is similar in many respects to the ring described above. The upper ring 330 is stackable on, and rotatably engages, the frame 318, while the extension ring 134 is stackable on, or received by the upper ring 330. The cover 14 is removably disposed on the extension ring 134, and thus is removably disposed over the opening of the frame 318. Both the rotatable or upper ring 330 and the extension ring 134 can be annular or ring-like, and have access holes formed therethrough. It is of course understood, that the rings 330 and 134 can be of any shape. The cover 14 preferably is a standard cover. Thus, the extension ring 134 can have an opening 342 (FIG. 6) sized and shaped to receive the cover 14 (similar to that described for the upper ring 18 in FIG. 1).

Referring to FIG. 2, as stated above, the utility access device 310 includes an angle adjustment means to selectively orient the cover 14 with respect to the frame 318. The frame 318 has a bottom edge 370 which can be disposed on a utility or manhole extension (6 in FIG. 1). The bottom edge 370 is commonly oriented horizontally, or perpendicular to vertical. Preferably, the frame 318 also has a top edge 374 which advantageously is angled with respect to the bottom edge 370. The frame 318 has a perimeter wall 376 which varies in height from a shorter end to an opposite higher end.

Figure 3:
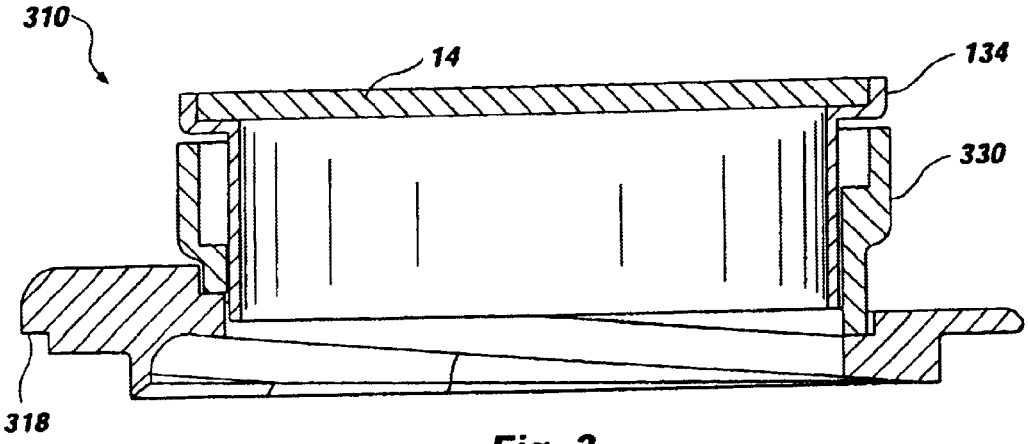
FIG. 3 is a cross sectional side view of the utility access device of FIG. 2, shown in a first lower position, and a first zero pitch orientation.
Figure 4:
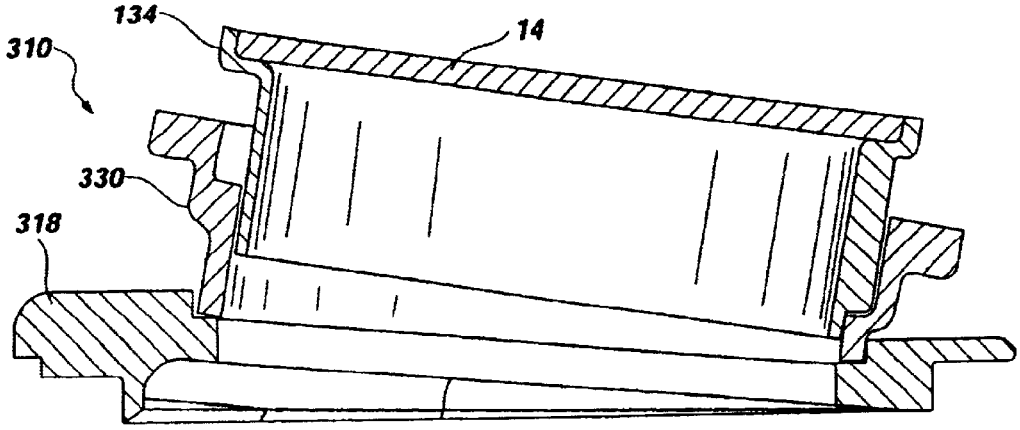
FIG. 4 is a cross sectional side view of the utility access device of FIG. 2, shown in a second higher position, and a second angled orientation.
Figure 5:
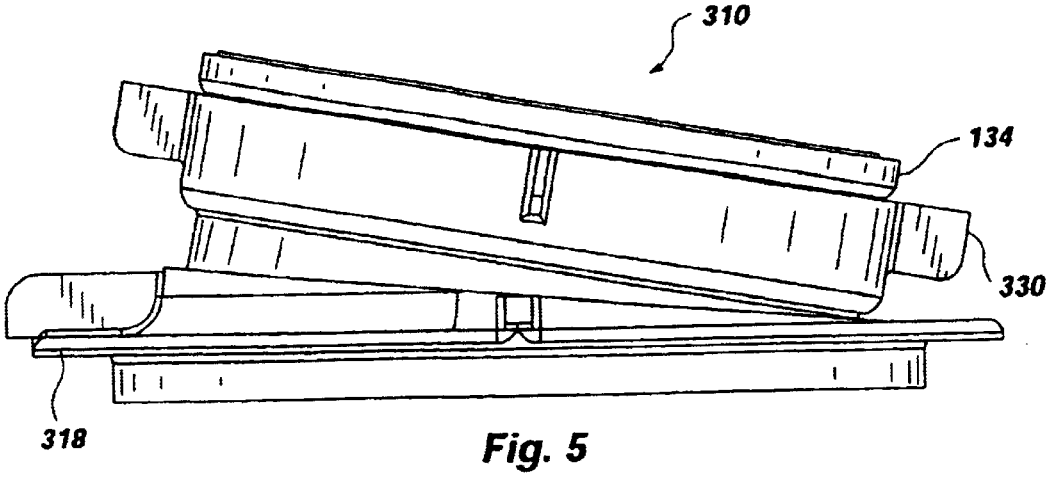
FIG. 5 is a side view of the utility access device of FIG. 2, shown in the first lower position, and the second angled orientation.

In addition, the upper ring 330 preferably has a bottom edge 378 which is angled with respect to a top edge 382. The adaptor ring 330 has a perimeter wall 384 which varies in height from a shorter end to an opposite higher end. The angled bottom edge 378 rotatably engages the angled top edge 374 of the frame 318. Thus, the angular orientation of the upper ring 330, or top edge 382 thereof, can be selectively oriented with respect to the frame 318, or bottom edge thereof 370. For example, the upper ring 330 and frame 318 can have a first position in which the top edge 382 of the upper ring 330 is parallel with the bottom edge 370 of the frame 318, such as by aligning the shorter end of the adaptor ring 330 with the higher end of the frame 318, as shown in FIG. 3. In addition, the upper ring 330 and frame 318 can have a second position in which the top edge 382 of the upper ring 330 forms an angle with respect to the bottom edge 370 of the frame 318, as shown in FIG. 4. Such an angle can be formed by selectively orienting or rotating the upper ring 330 with respect to the frame 318. It will be appreciated that a maximum angular orientation can be achieved by aligning the higher ends of the upper ring 330 and frame 318.

In one aspect, the angled top edge 374 of the frame 318 forms an angle with respect to the bottom edge 370 greater than 0 degrees, and less than or equal to 10 degrees. Similarly, the angled bottom edge 378 of the upper ring 330 preferably forms an angle with respect to the top edge 382 greater than 0 degrees, and less than or equal to 10 degrees. Thus, the upper ring 330 and frame 318 can be oriented or rotated with respect to one another to vary the angle between the bottom and top edges 370 and 382 between 0 and twenty degrees.

The angled edges 374 and 378 between the upper ring 330 and frame 318, or between the frame 318 and cover 14, are one example of an angle adjustment means for adjusting the angle of the cover 14 relative to the frame 318. It is of course understood that other means can be used, including for example, different angled edges, etc. It also is understood that the locations of the height adjustment means and the angle adjustment means can be reversed.

In addition, the rings and frame can be permanently fixed to each other by means of bolts, or pegs, or other secure means of bonding after having been adjusted. In addition, the rings also could be made with appropriate hand-grips, or means of inserting external handles, to facilitate the workers in repositioning the height adjustment.

Referring to FIG. 2, the frame 318 can include one or more protrusions 290 formed thereon and extending outwardly in a radial direction past the circumference or perimeter of the frame 318. Similarly, the adaptor ring 330 can include one or more protrusions 294. The protrusions 290 and 294 preferably are plate like or have flat faces. The protrusions 290 and 294 form, or act as, anchors to resist movement and/or pivoting of the frame 318 or adaptor ring 330 after installation. Typically, concrete or asphalt is poured around the frame 318 and adaptor ring 330, and thus around the protrusions 290 and 294.

Figure 6:
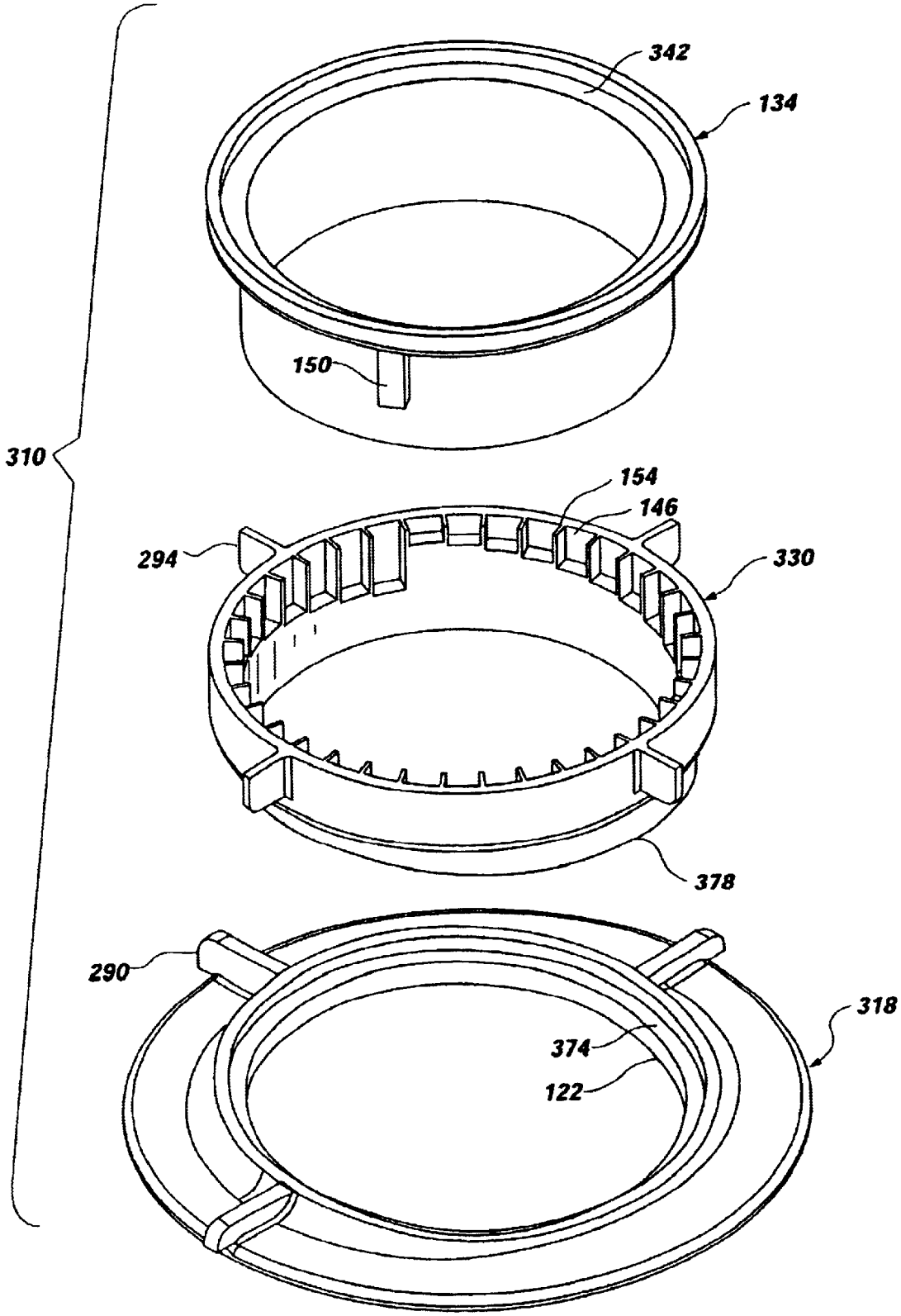
FIG. 6 is an exploded perspective view of the utility access device of FIG. 2.

Referring to FIG. 6, the top edge 374 of the frame 318 can be configured to receive the bottom edge 378 of the upper ring 330. The top edge 374 can have a lip or flange upon which the bottom edge 378 abuts, and a perimeter wall surrounding the bottom edge 378. Thus, the upper ring 330 can rotate within the frame 318. It is of course understood that the mating structure can be reversed so that the top edge of the frame is received within the bottom edge of the adaptor ring.

In addition, the utility access device also can be height adjustable. The upper ring 330 can include a plurality of steps or pockets 146 (FIG. 6), while the extension ring 134 (FIGS. 2 and 6) includes one or more mating tabs 150 which engage or selectively mate with the steps or pockets 146 to selectively position the tabs 150, and thus the extension ring 134 and cover 14, at a desired elevation. The plurality of steps or pockets can be formed in an inner surface or circumference of the upper ring, and are disposed at different elevations. The plurality of steps or pockets can include three sets of steps or pockets, each with a matching plurality of steps or pockets. It is believed that three sets of steps or pockets and three tabs provides the greatest stability between the upper ring and extension ring, and greatest flexibility in tolerances. For example, it is believed that three tabs can engage or rest on three steps without wobbling, and without meeting exacting tolerances.

The plurality of steps or pockets can be conceptualized in different ways. The upper ring can have a plurality of steps arranged in a stair-like fashion around the interior of the upper ring, with each subsequent step being at a higher or lower elevation as the steps extend around the upper ring. The upper ring also can have a plurality of pockets or indentations formed in the inner surface and upper edge of the upper ring. The pockets can have bottom walls at different elevations, or the pockets can have different depths from the upper edge. In addition, adjacent steps or pockets can be separated by walls which prevent the tabs from inadvertently moving from one step to another. For example, a wall can be formed between a step and a proximal lower step to prevent the tab from sliding off the step to the lower step under an applied force and/or vibration.

The one or more tabs can be formed on the extension ring 134. The tabs 150 can be formed on the exterior surface or outer circumference of the extension ring 134. As stated above, the extension ring 134 preferably has three tabs 150. The tabs 150 have a bottom surface which engages or rests on the steps 146. In addition, the tabs 150 can be sized and shaped to mate with the pockets 146.

The extension ring 134 can be vertically manipulated, indicated by arrow 158 (FIG. 2), with respect to the upper ring 330. For example, the extension ring 134 can be lifted vertically upwardly from the upper ring 330, and/or vertically placed on or in the upper ring 330. In addition, the extension ring 134 can be rotated with respect to the upper ring 330. Thus, the extension ring 134 can be displaced vertically upwardly, and rotated, with respect to the upper ring 330 to position the extension ring 134 at a desired height with respect to the upper ring 330. For example, to increase the height, or elevate, the extension ring 134, the extension ring 134 is lifted and turned so that the tab 150 engages a higher step or pocket 146 (FIG. 6). With walls 154 extending to the top or upper edge of the upper ring 330, it may be necessary to completely remove the extension ring 134 from the upper ring 330 prior to rotation. Thus, the extension ring 134 can have a plurality of positions or rotational orientations with respect to the upper ring 330 which result in different heights or elevations of the extension ring 134. For example, the extension ring 134 can have a first position in which the tabs 150 rest on first steps or in first pockets 146 (FIG. 6) to maintain the cover 14 at a first height, as shown in FIG. 3, and at least a second position in which the tabs 150 rest on different second steps or in different second pockets at a different elevation to maintain the cover 14 at a different second height, as shown in FIG. 4.

The extension ring 134 can be sized and shaped to extend into the upper ring 330. The extension ring 134 can have a vertical skirt or extension 166 with a length or height sized to completely cover the steps or pockets when the extension ring 134 is received within the upper ring 330, thus preventing access to any cavities created by the steps from inside the rings.

The upper ring 330 with steps 146 and the extension ring 134 with tabs 150 are one example of a height adjustment means for adjusting the height of the cover 14 relative to the frame 318. It is of course understood that other means can be used, including for example: exterior steps or pockets, and interior tabs; steps on the extension ring, and tabs on the adaptor ring; steps or tabs directly on the frame; a plurality of steps forming the tabs; various different numbers of sets of steps and/or tabs; etc. Other examples of height adjustment means are described below with respect to alternative embodiments. One advantage of the upper ring 330 and extension ring 134 is that they can be used with typical or existing frames 318 and covers 14.

It is noted that the height adjustment means and angle adjustment means are illustrated to be positioned between the cover 14 and the frame 318. Both, however, can be placed below the frame 318, and above the manhole extension 6, and still achieve the same results.

As discussed above, obtaining the desired angle can be difficult. In addition, the orientation of the created angle also changes as the angle is adjusted by the rotating rings. Thus, it will also be appreciated that properly orienting the created angle also can be difficult.

Figure 9A:
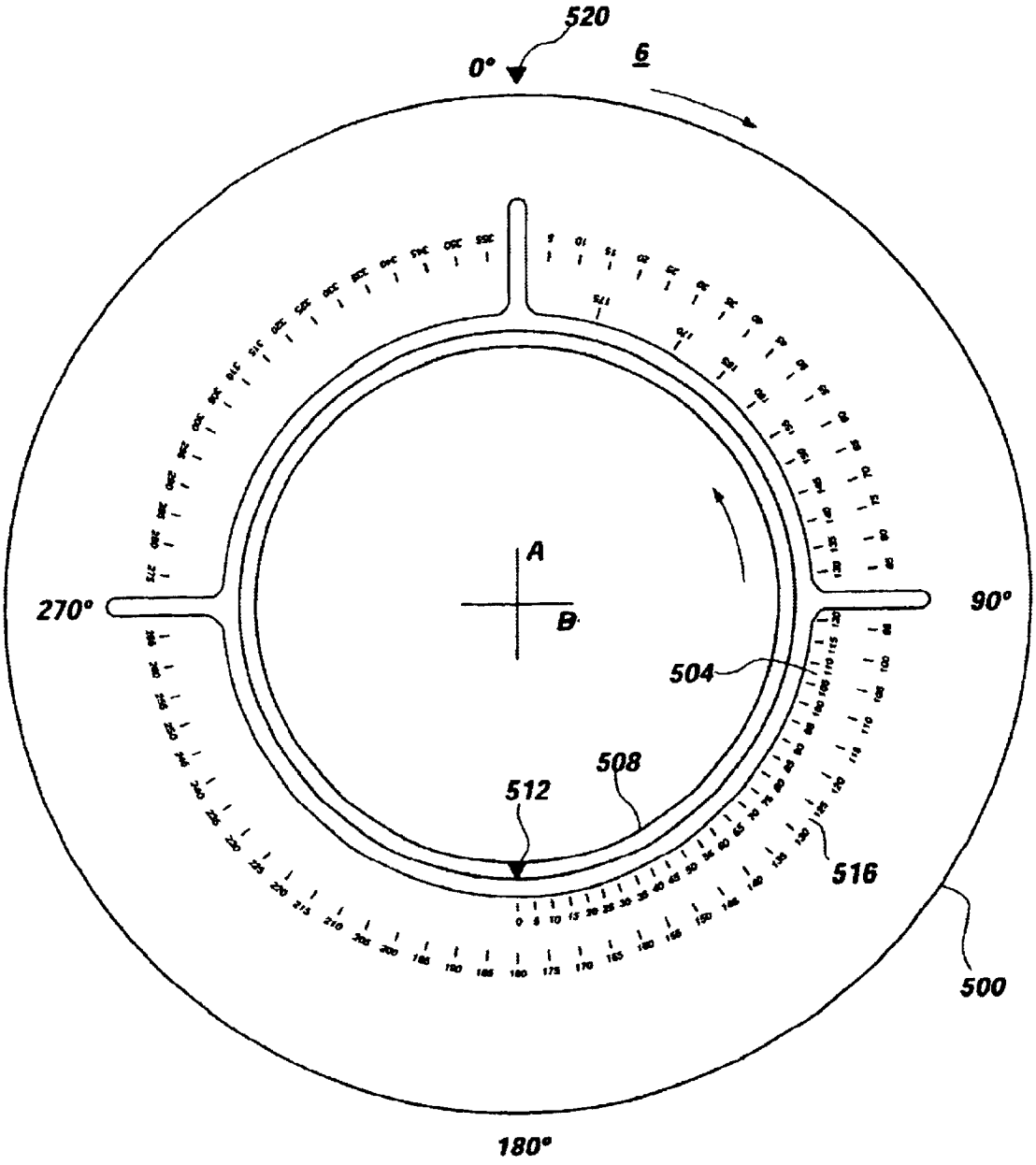
FIGS. 9*a* and *b* are top schematic views of a device and method in accordance with the present invention.
Figure 9B:
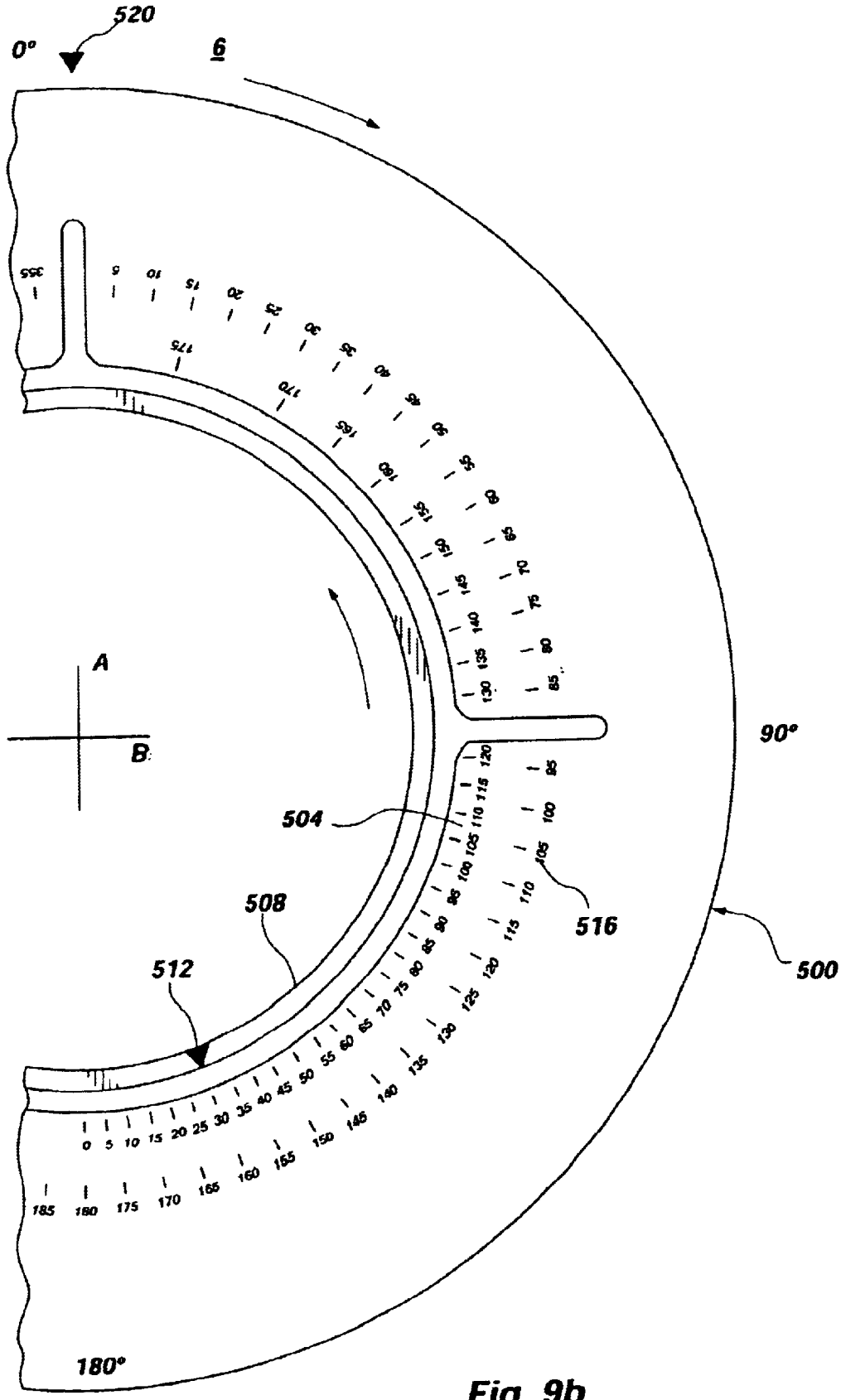
Figure 10A:
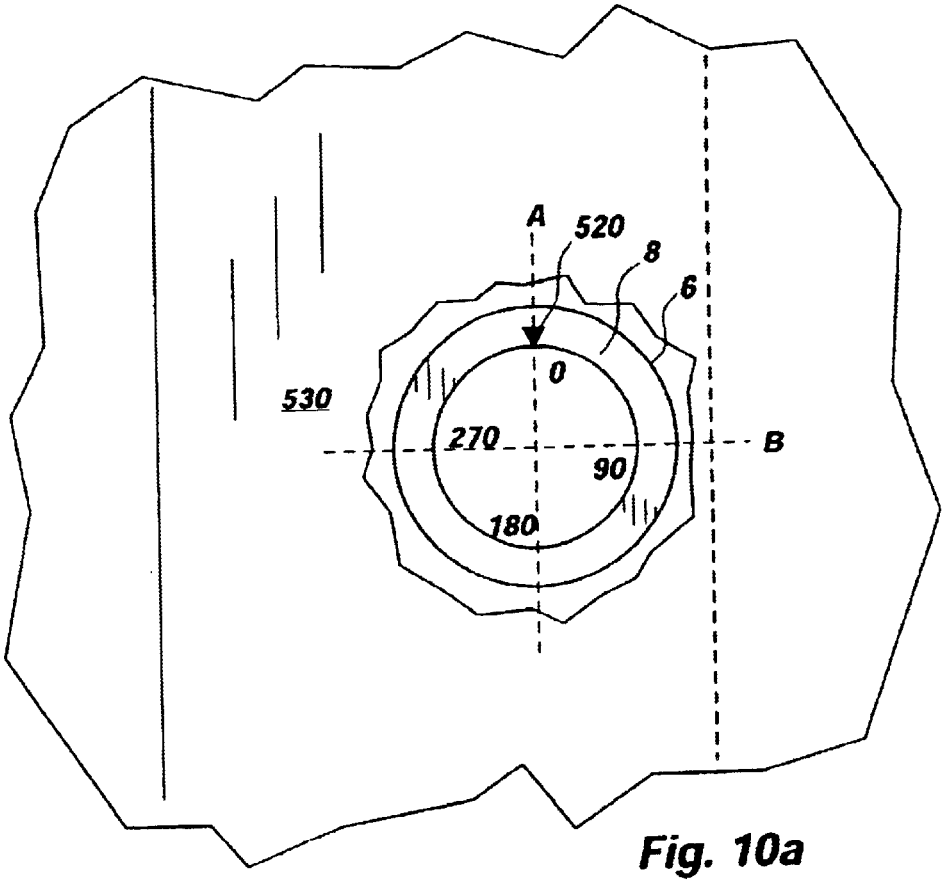
FIGS. 10*a–c* are schematic views of a method in accordance with the present invention.
Figure 10B:
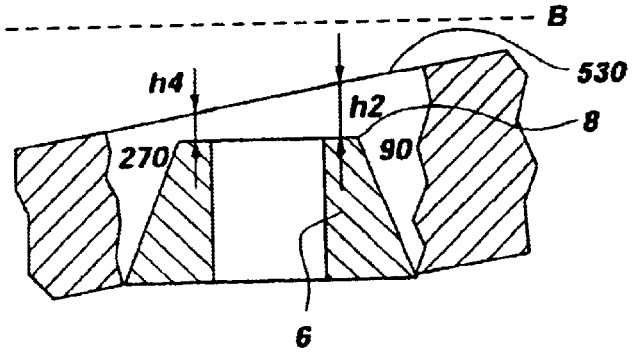
Figure 10C:
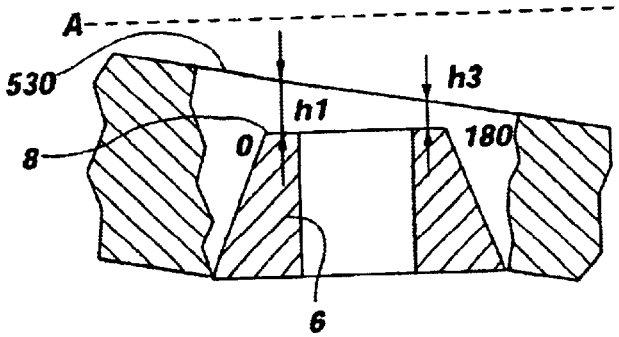

The angled rings can be provided with a vertical angle scale and an indicator to facilitate indication of the inclination angle formed between the upper and lower ends of the rings caused by the relative rotational orientation of the rings with respect to one another. Referring to FIGS. 9*a* and *b*, a frame or lower ring 500 can be provided with a vertical angle scale 504, while the rotatable or upper ring 508 can be provided with an indicator 512. The frame 500 and upper ring 508 are similar in many respects to those described above. The vertical angle scale 504 can include indicia indicative of the vertical angle formed between the upper and lower ends of the rings. As the rings 500 and 508 are rotated with respect to one another, the indicator 512 moves with respect to the vertical angle scale 504, and can align with the indicia on the vertical angle scale 504 to indicate the angled formed by the upper and lower ends of the rings. The indicia can be indicative of the angle formed between the upper and lower ends of the rings. The indicia can express the angle in various different ways or formats, including degrees, radians, percentage, etc. The vertical angle scale can be non-linear, or can include unequal increments spaced apart unequal distances along a length of the scale. The indicia, however, can be of equal incremental values, and can be associated with the unequal increments. The angle created by the rings is non-linear with respect to the degree or amount of rotation of the rings. Thus, the vertical angle scale can assist in determining the angle created as the rings are rotated, especially due to the non-linear increase in angle as the rings are rotated.

As described above, as the rings are rotated, the angle between the upper and lower ends changes. In addition, the horizontal orientation of the angle created also changes. Thus, horizontal orientation indicia can be formed on one of the rings to facilitate horizontal orientation of the inclination angle of the rings. The frame or lower ring 500 also can include horizontal orientation indicia 516. The horizontal orientation indicia can include a scale. For example, the scale and indicia can extend around a circumference of the frame. A reference point 520 can be associated with the utility 6, and can align with the horizontal orientation indicia to horizontally orient the inclination angle formed between the upper and lower ends of the rings.

As described above, rotating the rings with respect to one another not only changes the inclination angle formed by the rings, but also changes the horizontal orientation of the rings. It will be appreciated that matching the inclination angle, in both magnitude and orientation, with a surface can be difficult. It also will be appreciated that typical installation crews lack the training and skill to mathematically determine the proper angle and alignment; an inordinate amount of time can be expended by the installation crews in attempting to obtain the proper angle and orientation by trial and error; and requiring the presence and assistance of a project engineer for every utility installation can be costly. Thus, the present invention advantageously includes means for determining one or more rotational settings to obtain the inclination angle and/or horizontal orientation utilizing tools and skills typically possessed by a typical installation crew. For example, typical tools can include tape measures and level, while typical skills can include measuring and leveling.

The rotational settings can include a first angle setting corresponding to a desired inclination angle formed between the upper and lower ends of the rings. In addition, the rotational settings can include a second orientation setting corresponding to a desired horizontal orientation of the desired inclination angle. The means for determining one or more rotational settings can utilize a plurality of simple measurements to provide the rotational settings. The means for determining the rotational settings can include a spreadsheet, such as on a computer, a calculator, a hand-held personal digital assistant (PDA), etc.; a computer program, such as a software program operating on a computer, a calculator, a hand-held personal digital assistant (PDA), etc.; a calculator, such as a general function calculator programmed to perform calculations, or a special calculator configured specifically to calculate the rotational settings; a slide rule configured to calculate the rotational settings; a chart containing a plurality of pre-calculated values, etc. The calculations can be made as discussed below.

A method for adjusting an adjustable utility access as described above with respect to a road surface is illustrated in FIGS. 9*a*–10*c*. The method can include providing upper and lower angled rings on a utility, as described above. A reference point 520 can be selected on the utility 6. The reference point 520 can be located or positioned at an upward or forward position of the roadway. A plurality of distances can be measured between a top 8 of the utility 6 to a reference elevation 530. The reference elevation 530 can be the roadway or surface of the roadway. The distances can be measure at a plurality of different points around the utility. For example, four distances can be measured at four, equally spaced, circumferential positions around an opening in the utility, such as at 0°, 90°, 180° and 270° with respect to the reference point 520. The reference point 520 and measurement positions can be selected so that two distances 0° and 180° are measured on an axis (represented by line A) parallel with the roadway, and two distances 90° and 270° are measured on an axis (represented by line B) perpendicular with the roadway. In addition, the diameter of the rings can be measured, if not already known.

The method advantageously includes determining one or more rotational settings based on the distances measured, and the diameter of the rings. The rotational settings can including 1) a first angle setting corresponding to a desired inclination angle formed between the upper and lower ends of the rings, and 2) a second orientation setting corresponding to a horizontal orientation of the inclination angle of the rings. The rotational settings can be determined utilizing the determining means, such as a spreadsheet, a computer program, a calculator, a slide rule, a chart, etc. The rotational settings determined by the determining means allow the rings to be rotated and oriented to obtain the proper inclination angle and horizontal orientation without requiring complicated calculations or trial-and-error by the installation crew. Thus, the determining means only requires simple measurements to be made, and performs any necessary calculations.

The rings can be rotated to the first and second rotational settings. For example, the lower ring can be positioned on the utility, and rotated to the second orientation heating. The horizontal orientation indicia on the frame or lower ring can be aligned with the reference point on the utility. The upper ring can be positioned on the lower ring or frame, and rotated to the first angle setting. The indicator on the upper ring can be aligned with the vertical angle scale on the lower ring or frame. It is of course understood that the upper ring can first be positioned with respect to the lower ring, and then the lower ring positioned with respect to the utility.

In order to obtain the two rotational settings, the determining means, such as a spreadsheet, can perform the following calculations:

1) Calculate the difference between the measurements on opposing sides of the utility along axes A and B:

$$A=h1-h3$$

$$B=h2-h4$$

where:

A is the difference between the measurements at 0° and 180°;

h1 is the measurement at 0°;

h3 is the measurement at 180°;

B is the difference between the measurements at 90° and 270°;

h2 is the measurement at 90°; and h4 is the measurement at 270°.

2) Calculate the slope along the axes A and B by dividing the difference in elevation by the horizontal distance or diameter:

$$A'=A/d$$

$$B'=B/d$$

where:

A' is the slope along axis A;

B' is the slope along axis B'; and d is the diameter of the rings, or horizontal distance.

3) Calculate a compass heading C of a line where the two slopes intersect:

$$C=arctan(B'/A')$$

The compass heading C can be determined in radians and converted to degrees between 0 and 90 degrees to keep the compass heading C positive. (If A=0, or there is no slope along the A axis, then the calculation of C is made with A' as a small number, such as 0.00001.)

4) Calculate the slope S:

$$S=A'\cos(C)+B'\sin(C)$$

The slope S can be expressed as a percentage. In addition, the slope S can be the first angle setting.

One of the rings can be rotated with respect to the other to the first angle setting. For example, the upper ring can be rotated until the indicator 512 aligns with the indicia on the vertical angle scale 504 that equals the slope S. The indicia on the vertical angle scale can include values of the angle setting. Thus, the determining means provides the angle setting based on the measurements to allow the rings to be easily rotated to obtain the desired inclination angle formed between the upper and lower ends of the rings.

5) Calculate a rotation angle RA with respect to the rings that obtains the slope S:

$$RA=2arcsin(S/maxA)$$

Where:

maxA is the maximum capable angle of the rings. For example, if the rings each have a 5 degree angle, then the maximum capable angle is 10 degrees.

6) Calculate a rotation heading of the rotation angle as follows:

If the compass heading HDG is 0, then the rotation heading is 0; otherwise the rotation heading is −½ rotation angle +90.

7) Calculate the difference between the rotation from the heading: rotation heading—compass heading.

8) Set a start point as follows:

If the difference between the rotation and compass heading less than 0, then the starting point is the difference +360; otherwise the start point is the difference.

The start point can be the second orientation setting. The lower ring can be rotated with respect to the utility to the second orientation setting to obtain a desired horizontal orientation of the inclination angle of the rings. The horizontal orientation indicia 516 can include values of the second orientation setting. The lower ring can be rotated to align the orientation setting of the horizontal orientation indicia with the reference point 520 of the utility. Thus, the determining means provides the orientation setting based on the measurements to allow the rings to be easily rotated to obtain the desired horizontal orientation of the inclination angle.

It should be noted that most top manhole assemblies are of a fixed height and fixed angular orientation design. In a typical installation the manhole is located in a road for access to a sewer. When a subsequent layer of material is added to the surface, the manhole covers are no longer flush with the road surface. In one application of the present invention, the height or elevation of the cover 14 is increased, and the angular orientation adjusted. This provides a cost effective and efficient means of adjusting the height and angular orientation of manhole cover assemblies to match the surrounding surface.

Figure 11A:
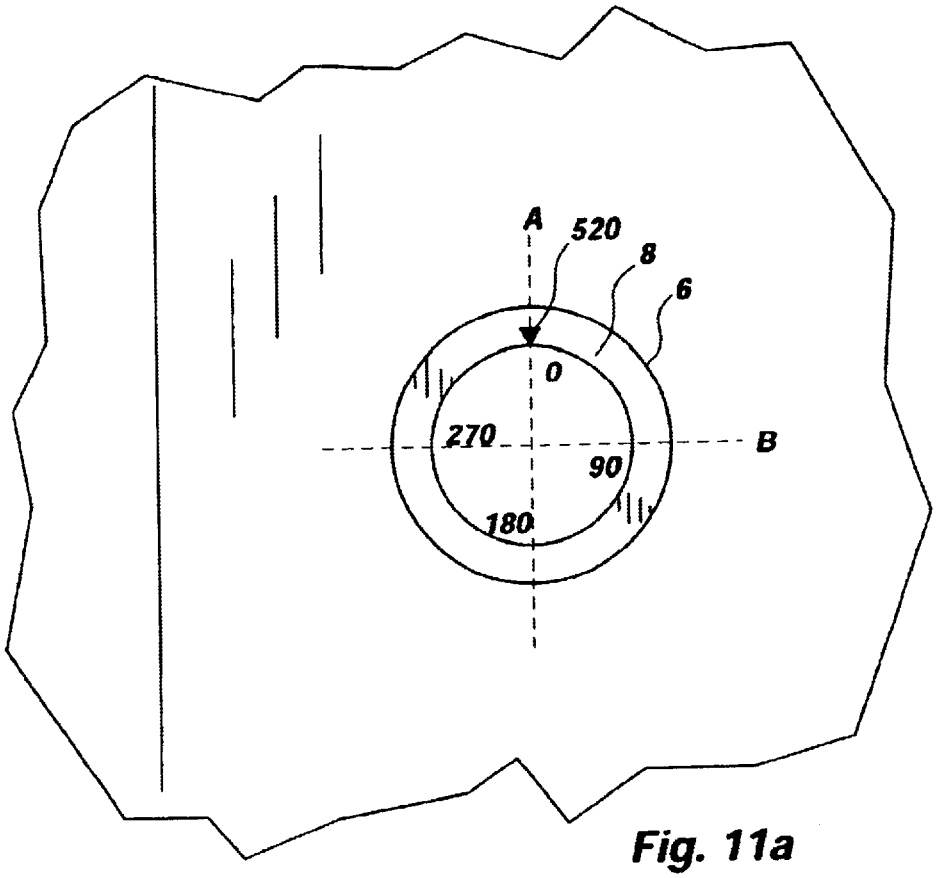
FIGS. 11*a–c* are schematic view of a method in accordance with the present invention.
Figure 11B:
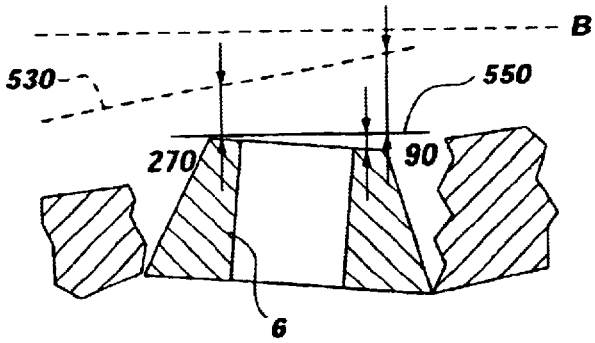
Figure 11C:
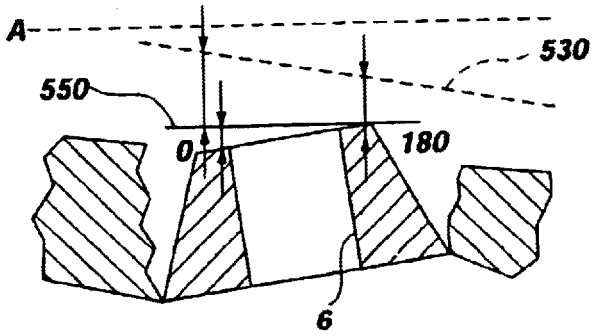

As described above, the measurements can be made between the utility and a reference elevation 530, such as a roadway. Such an approach can be suited for a retrofit installation with an existing utility and roadway. The method and determining means also can be used with new installations, as shown in FIGS. 11*a–c*. In such a case, the reference elevation can be a level 550, and the measurements can be made from the utility to the level. Each measurement can be supplemented with a plurality of second distances from the level to the future roadway, or determined from the level to the planned roadway. Alternatively, the slope and cross slope can be obtained from engineering plans for the road, and the measurements made from the utility to the level. Of course, if the utility is level, then the measurements are unnecessary and the slope and cross slope can be used.

The height can be adjusted by selectively rotating a third ring with respect to the upper ring. Tabs can selectively engage with a plurality of different elevated steps to selectively elevate the third ring with respect to the upper ring. The tabs and the steps can each be formed on a different one of the third and upper rings so that the tabs and steps are disposed between the third and upper rings.

In addition, a method for adjusting an adjustable utility access with respect to a road surface can include selecting a reference point on the utility, and selectively orienting a first angled ring on the utility with respect to the reference point. A second angled ring is rotatably disposed on the first ring and selectively rotated to obtain a desired inclination angle of an upper end of the second angled ring. A horizontal orientation of the desired inclination angle can be determined with respect to the reference point. The first angled ring is rotated on the utility to align the horizontal orientation to orient the desired inclination angle with respect to the reference point.

Figure 7:
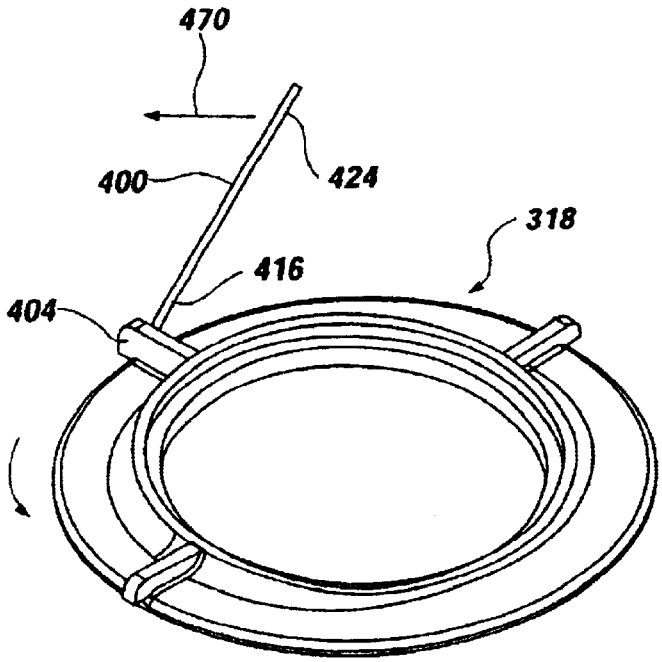
FIG. 7 is a perspective view of the frame of the utility access device of FIG. 2, showing a method for rotating the frame in accordance with the present invention.
Figure 8:
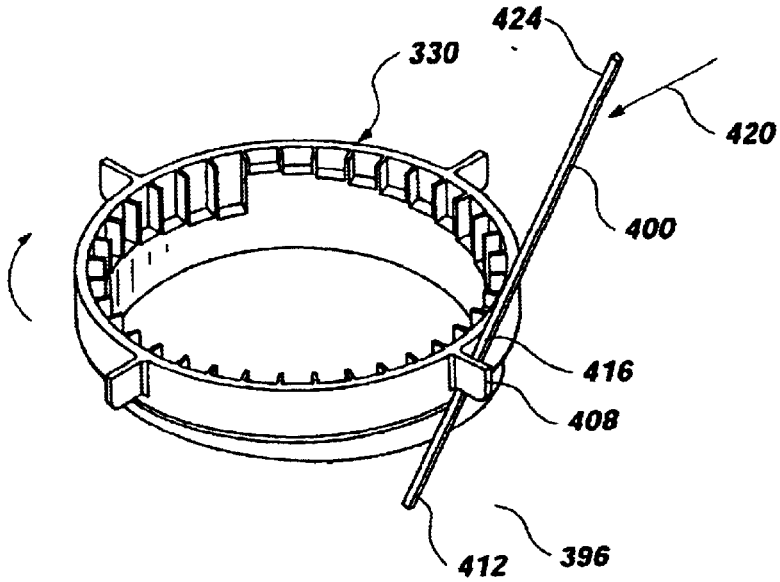
FIG. 8 is a perspective view of the adaptor ring of the utility access device of FIG. 2 showing a method for rotating the adaptor ring in accordance with the present invention.

Referring to FIGS. 7 and 8, the frame 318 and upper ring 330 can be rotated with respect to one another or the utility or ground 396 using a lever arm 400 and protrusions formed on, and extending from, the frame and upper ring. The frame can have one or more protrusions 404 extending therefrom in a radial direction, and extending beyond the circumference or perimeter of the frame 318. Similarly, the upper ring 330 can have one or more protrusions 408. The lever arm 400 can be used to engage the protrusions 404 or 408 to pivot the respective frame 318 or adaptor ring 330.

Referring to FIG. 8, the step of selectively rotating the upper ring can further include engaging the ground 396 with a distal end 412 of the lever arm 400. The protrusion 408 can be engaged by an intermediate portion 416 of the lever arm 400. The intermediate portion 416 is adjacent the distal end 412. Force, indicated by arrow 420, can be applied to a proximal end 424 of the lever arm 400 to pivot the lever arm 400 about the distal end 412, thus causing the intermediate portion 416 to move against the protrusion 408 and rotate the upper ring 330. Thus, the upper ring 330 can be pivoted with respect to the frame 318 to pivot the first and second angled edges 374 and 378 and adjust the angle of the upper end of the adaptor ring 330, and thus the cover 14.

Similarly, the frame 318 can be pivoted or rotated to further orient the angle of the cover 14. Referring to FIG. 7, the lever arm 400 can engage the ground 396 with its distal end 412, and engage the protrusion 404 with its intermediate portion 416. Force 420 can be applied to the proximal end 424 of the lever arm 400 to pivot the lever arm 400 about its distal end 412 causing the intermediate section 416 to move against the protrusion 404 and rotate the frame 318. Thus, the frame 318 can be pivoted or rotated to orient the angle of the cover 14.

It will be appreciated that the frame 318 and the upper ring 330 can have significant weight, and thus be difficult to pivot or rotate by hand. In addition, it will be appreciated that the frame 318 and the adaptor ring 330 are located near ground level, making it difficult for workers to squat and turn. Thus, the lever arm 400 and protrusions 404 and 408 advantageously provide a method for pivoting or rotating the frame 318 and upper ring 330. In addition, the protrusions 404 and 408 can act as anchors to resist further movement as concrete or asphalt us poured about the frame and adaptor ring.

It is further noted that each ring section is designed to withstand the full weight of any passing vehicle. These sections are desired to be made of cast iron or other strong materials. They are designed to be sold in combination and are not made to be separate from each other.

One skilled in the art would be capable of making many obvious design changes which would stay within the scope of the invention disclosed in this application. It is noted that cement extension 6 is illustrated as having no groove therein to accommodate the insertion of the base ring 16. However, it is also understood that there are many ways to place the lower ring 16 over the extension 6. For example, the base ring 16 could be bolted thereon, or could even be threaded to the extension 6.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A method for adjusting an adjustable utility access with respect to a road surface, comprising the steps of:

a) providing upper and lower angled rings on a utility, the angle rings engage and rotate with respect to one another, the rings together having an upper end and a lower end, the lower angled ring also having at least one scale with horizontal orientation indicia;

b) selecting a reference point on the utility;

c) measuring a plurality of distances between a top of the utility to reference elevations at a plurality of different points around the utility;

d) calculating two rotational settings based on the distances measured and a horizontal distance between distances measured, the rotational settings including a first angle setting corresponding to a desired inclination angle formed between the upper and lower ends of the rings, and a second orientation setting corresponding to a horizontal orientation of the inclination angle of the rings;

e) aligning one of the rings with respect to the other ring to the first angle setting to obtain the desired inclination angle formed between the upper and lower ends of the rings; and f) aligning the second orientation setting on the scale of the lower ring with respect to the reference point on the utility to obtain a desired horizontal orientation of the inclination angle of the rings.

2. A method in accordance with claim 1, wherein the step of measuring further includes measuring four distances at four, equally spaced, circumferential positions around an opening in the utility; and wherein the step of determining further includes determining two rotational settings based on the four distances measured and a diameter of the opening.

3. A method in accordance with claim 2, wherein the step of measuring four distances further includes measuring two of the distances on an axis parallel with the roadway, and measuring two of the distances on an axis perpendicular with the roadway.

4. A method in accordance with claim 1, wherein the step of providing two angled rings further includes providing two angle rings having an angle scale with angle indicia; and wherein the step of aligning one of the rings further includes rotating the ring to align a reference on one ring with the first angle setting on the angle scale.

5. A method in accordance with claim 1, wherein the step of calculating further includes entering the distances measured into means for determining the two rotational settings.

6. A method in accordance with claim 5, wherein the step of entering the distances measured into means for determining further includes utilizing means selected from the group consisting of: a spreadsheet, a computer program, a calculator, a slide rule, and a chart.

7. A method in accordance with claim 1, wherein the reference elevations include a surface of a roadway; and wherein the step of measuring further includes measuring the plurality of distances between the top of the utility to the surface of the roadway.

8. A method in accordance with claim 1, wherein the reference elevations include a level; and wherein the step of measuring further includes measuring the plurality of distances between the top of the utility to the level.

9. A method in accordance with claim 8, further comprising the step of:

measuring a second plurality of distances between the level and the surface of the roadway.

10. A method in accordance with claim 1, further comprising the step of:

selectively rotating a third ring with respect to the upper ring to selectively engage tabs with a plurality of different elevated steps to selectively elevate the third ring with respect to the upper ring, the tabs and the steps each being formed on a different one of the third and upper rings so that the tabs and steps are disposed between to third and upper rings.

11. A method in accordance with claim 1, wherein the step of rotating the lower ring further includes the steps of:

a) engaging the ground with a distal end of a lever arm;

b) engaging a protrusion which extends from the lower ring with an intermediate section of the lever arm which is adjacent the distal end; and c) pivoting the lever arm about the distal end thereof by applying a force to a proximal end of the lever arm.

12. A method in accordance with claim 1, wherein the step of rotating one of the rings further includes the steps of:

a) engaging the ground with a distal end of a lever arm;

b) engaging a protrusion which extends from one of the rings with an intermediate section of the lever arm which is adjacent the distal end; and c) pivoting the lever arm about the distal end thereof by applying a force to a proximal end of the lever arm.

13. A method in accordance with claim 1, wherein the step of calculating two rotational settings further includes utilizing means for determining the two rotational settings that:

a) calculates differences between the distances on opposing sides of the utility;

b) calculates two slopes across the opposing sides of the utility using the differences and a diameter of the opening;

c) calculates a compass heading of a line where the two slopes intersect using the two slopes;

d) calculates the first angle heading based on the two slopes and the compass heading;

e) calculates a rotation angle with respect to the rings based on the first angle heading and a maximum angle capable of the rings;

f) calculates a rotation heading of the rotation angle with respect to a compass heading; and g) calculates the second orientation setting.

14. A method for adjusting an adjustable utility access with respect to a road surface, comprising the steps of:

a) providing upper and lower angled rings on a utility, the angle rings engage and rotate with respect to one another, the rings together having kit upper end and a lower end, the lower angled ring also having at least one scale with horizontal orientation indicia;

b) selecting a reference point on the utility;

c) measuring four distances at four, equally spaced, circumferential positions around an opening in the utility between a top of the utility to reference elevations at a plurality of different points around the utility;

d) calculating two rotational settings based on the four distances measured and a diameter of the opening, the rotational settings including a first angle setting corresponding to a desired inclination angle formed between the upper and lower ends of the rings, and a second orientation setting corresponding to a horizontal orientation of the inclination angle of the rings;

e) rotating one of the rings with respect to the other ring to the first angle setting to obtain the desired inclination angle formed between the upper and lower ends or the rings; and f) rotating the lower ring with respect to the utility to align the second orientation setting on the scale of the lower ring with the reference point on the utility to obtain a desired horizontal orientation of the inclination angle of the rings.

15. A method in accordance with claim 14, wherein the step of measuring four distances further includes measuring two of the distances on an axis parallel with the roadway, and measuring two of the distances on an axis perpendicular with the roadway.

16. A method in accordance with claim 14, wherein the step of calculating two rotational settings further includes utilizing means for determining the two rotational settings that:

a) calculates differences between the distances on opposing sides of the utility;

b) calculates two slopes across tire opposing sides of the utility using the differences and a diameter of the opening;

c) calculates a compass heading of a line where the two slopes intersect using the two slopes;

d) calculates the first angle heading based on the two slopes and the compass heading;

e) calculates a rotation angle with respect to the rings based on the first angle heeding and a maximum angle capable of the rings;

f) calculates a rotation heading of the rotation angle with respect to a compass heading; and g) calculates the second orientation setting.

17. A method in accordance with claim 14, wherein the step of calculating further includes entering the distances measured into means for determining the two rotational settings.

18. A method for adjusting an adjustable utility access with respect to a road surface, comprising the steps of:

a) placing upper and lower angled rings on a utility, thee angle rings engage and rotate with respect to one another, the rings together having an upper end and a lower end;

b) selecting a reference point on the utility;

c) measuring a plurality of distances between a top of the utility to reference elevations at a plurality of different points around the utility;

d) entering the distances measured into a means for determining two rotational settings including a first angle setting corresponding to a desired inclination angle formed between the upper and lower ends of the rings, and a second orientation setting corresponding to a horizontal orientation of the inclination angle of the rings;

e) aligning one of the rings with respect to the other ring to align a reference on one ring with the first angle setting on a first scale with indicia on the other ring to obtain the desired inclination angle formed between the upper and lower ends of the rings; and f) aligning the lower ring with respect to the utility to align the reference point on the utility with the second orientation setting on a second scale with indicia on the lower ring to obtain a desired horizontal orientation of the inclination angle of the rings.

19. A method in accordance with claim 18, wherein the step of measuring further includes measuring four distances at four, equally spaced, circumferential positions around an opening in the utility.

20. A method in accordance with claim 19, wherein the step of measuring four distances further includes measuring two of the distances on an axis parallel with the roadway, and measuring two of the distances on an axis perpendicular with the roadway.

21. A method for adjusting an adjustable utility access with respect to a road surface, comprising the steps of:

a) placing a frame directly on the utility, the frame having:

1) a bottom edge, rotatably disposed on the utility;

2) an angled top edge, forming an angle between approximately two to ten degrees with the bottom edge;

3) a flange, extending outwardly from the bottom edge and configured to abut the upper surface of the manhole extension to support the frame on the manhole extension;

4) a shoulder, formed at the angled top edge of the frame and 5) a vertical wall, surrounding the shoulder of the frame;

b) placing a rotatable ring directly on the frame, the rotatable ring having:

1) a bottom edge, rotatably disposed on the shoulder of, and between the vertical wall of, the angled top edge of the frame;

2) an angled top edge, forming an angle between approximately two to ten degrees from the bottom edge of the rotatable ring;

3) a shoulder, formed at the angled top edge of the rotatable ring; and 4) a vertical wall, surrounding the shoulder of the rotatable ring; and c) selecting a reference point on the utility;

c) measuring a plurality of distances between a top of the utility to reference elevations at a plurality of different points around the utility;

d) determining two rotational settings based on the distances measured, the rotational settings including a first angle setting corresponding to a desired inclination angle formed between the angled top edge or the rotatable ring and the bottom edge or the frame, and a second orientation setting corresponding to a horizontal orientation of the inclination angle;

e) rotating the rotatable ring with respect to the frame to the first angle setting to obtain the desired inclination angle formed between the angled top edge of the rotatable ring and the bottom edge of the frame; and f) rotating the frame with respect to the utility to the second orientation setting to obtain a desired horizontal orientation of the inclination angle; and g) placing a cover directly on the shoulder of, and between the vertical wall of, the rotatably ring.

22. A method in accordance with claim 21, wherein the step of measuring further includes measuring four distances at four, equally spaced, circumferential positions around an opening in the utility.

23. A method in accordance with claim 22, wherein the step of measuring four distances further includes measuring two of the distances on an axis parallel with the roadway, and measuring two of the distances on an axis perpendicular with the roadway.

24. A method in accordance with claim 21, wherein the step of determining further includes entering the distances measured into means for determining the two rotational settings.

* * * * *